US009598831B2

(12) United States Patent
Lutenegger et al.

(10) Patent No.: US 9,598,831 B2
(45) **Date of Patent: *Mar. 21, 2017**

(54) HELICAL SCREW PILE

(71) Applicant: HUBBELL INCORPORATED, Shelton, CT (US)

(72) Inventors: Alan Lutenegger, Sunderland, MA (US); Gary Seider, Centralia, MO (US)

(73) Assignee: Hubbell Incorporated, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/833,166

(22) Filed: Aug. 24, 2015

(65) Prior Publication Data

US 2015/0368870 A1 Dec. 24, 2015

Related U.S. Application Data

(63) Continuation of application No. 14/353,974, filed as application No. PCT/US2012/061564 on Oct. 24,
(Continued)

(51) Int. Cl.
*E02D 5/56* (2006.01)
*E21B 17/22* (2006.01)
(Continued)

(52) U.S. Cl.
CPC ..... *E02D 5/56* (2013.01); *E02D 5/526* (2013.01); *E02D 7/22* (2013.01); *E21B 17/22* (2013.01)

(58) Field of Classification Search
CPC ... E02D 5/56; E02D 7/22; E21B 10/44; E21B 17/22
(Continued)

(56) References Cited

U.S. PATENT DOCUMENTS 1,567,829 A * 12/1925 Bettis ..... E21B 10/44 175/394
2,603,319 A * 7/1952 Dyche ..... E02D 5/801 175/394
(Continued)

FOREIGN PATENT DOCUMENTS

FR 2826050 A1 * 12/2002 ..... E02D 5/36
GB 2329200 A * 3/1999 ..... E02D 5/36

OTHER PUBLICATIONS

1996 Pipeline Anchoring Encyclopedia, A.B.. Chance Co, 1996, pp. 17, 20-21.
(Continued)

*Primary Examiner* — Frederick L Lagman
(74) *Attorney, Agent, or Firm* — Wissing Miller LLP

(57) ABSTRACT

A helical screw pile includes a longitudinal shaft having a top end and a bottom end with a plurality of helical plates arranged on the shaft in increasing diameter from the top to the bottom. The largest diameter helical plate is located toward the bottom of the shaft. A second helical plate having a diameter smaller than that of the first plate is located above the first helical plate. A smaller third helical plate is located above the second helical plate so that the smallest is located toward the top of the shaft. The helical plates can be spaced apart along the shaft or coupled together in an end-to-end manner to form a continuous helix.

27 Claims, 6 Drawing Sheets

Related U.S. Application Data

2012, now Pat. No. 9,115,478, which is a continuation-in-part of application No. 13/280,434, filed on Oct. 25, 2011, now Pat. No. 8,506,207.

(51) Int. Cl.
*E02D 7/22* (2006.01)
*E02D 5/52* (2006.01)

(58) Field of Classification Search
USPC ..... 405/252.1, 253; 175/323, 394
See application file for complete search history.

(56) References Cited

U.S. PATENT DOCUMENTS 2,727,730 A * 12/1955 Crake ..... E21B 10/26 175/394
3,537,537 A * 11/1970 Watson ..... E21B 10/44 175/388
4,290,245 A * 9/1981 Pardue, Jr. ..... E02D 5/801 52/157
4,986,375 A * 1/1991 Maher ..... E21B 10/003 175/323
6,033,152 A * 3/2000 Blum ..... E02D 5/36 175/325.3
6,058,662 A 5/2000 Perko
6,264,402 B1 7/2001 Vickars et al.
6,615,554 B2 9/2003 Rupiper
7,090,437 B2 8/2006 Pinkleton
7,494,299 B1 2/2009 Whitsett
7,510,350 B2 * 3/2009 Ronnkvist ..... E02D 5/801 405/231
7,635,240 B2 * 12/2009 Gantt, Jr. ..... E02D 5/801 405/252.1
8,079,781 B2 12/2011 Ronnkvist
8,506,207 B2 * 8/2013 Lutenegger ..... E02D 7/22 175/323
8,845,236 B1 * 9/2014 Dosdourian ..... E21B 10/44 175/19
9,115,478 B2 * 8/2015 Lutenegger ..... E02D 5/56
2004/0076479 A1 4/2004 Camilleri
2005/0074298 A1 4/2005 Jones
2009/0274522 A1 * 11/2009 Lei ..... E02D 3/12 405/232

OTHER PUBLICATIONS

International Search report for PCT/US2012/061564, dated Jan. 22, 2013.

* cited by examiner

HELICAL SCREW PILE

CROSS-REFERENCE TO RELATED APPLICATIONS

This application claims priority to co-pending U.S. application Ser. No. 14/353,974, filed on Apr. 24, 2014, entitled "HELICAL SCREW PILE" (now U.S. Pat. No. 9,115,478), which is a national stage application under 35 U.S.C. §371 of International Application No. PCT/US2012/061564 filed on Oct. 24, 2012, entitled "HELICAL SCREW PILE", which is a continuation-in-part of U.S. application Ser. No. 13/280,434 filed on Oct. 25, 2011, entitled "HELICAL SCREW PILE" (now U.S. Pat. No. 8,506,207), each of which is incorporated herein in their entirety by reference.

FIELD OF THE INVENTION

The present invention relates to a helical screw pile for use as a ground anchor having a longitudinal shaft with a top end and a bottom end with a plurality of helical screw plates arranged along the shaft in increasing diameter from the top to the bottom. The screw pile includes at least two helical plates but can include three, four or more helical plates where the lower helical plate of two adjacent plates has a larger diameter. The helical plates can form a substantially continuous helix or can be spaced apart. The distance between the lower plate and the plate directly above can vary depending on the soil type and diameter of the helical plates.

BACKGROUND OF THE INVENTION

Conventional helical screw piles include a plurality of helical plates arranged on a longitudinal shaft having a square cross section. Typically, the helical plate with the largest diameter is disposed towards the top of the shaft and the helical plate with the smallest diameter is disposed towards the bottom of the shaft that first penetrates the ground. Turning to FIG. 1, a conventional screw pile 100 includes a plurality of helical plates 120, 122, 124 arranged in descending order from the top 114 of the shaft 112 to the bottom 116 such that the helical plate 120 with the largest diameter closest to the top end 114 of the hydraulic motor 118 and the helical plate 124 with the smallest diameter adjacent the tip 130 of the pile 100.

Inter-helix spacing is critical to the design of the helical screw pile. Inter-helix spacing is the distance between each of the helical plates. Standard practice is to space the helical plates as a function of plate diameter so that the spacing between the uppermost plate and the middle plate is greater than the spacing between the middle plate and the lowermost plate. The most common inter-helix spacing in the industry provides spacing between the first lowermost plate and a second plate being less than the spacing between the second plate and the third uppermost plate.

A conventional screw pile shown in FIG. 1, where the helical plate 124 at the bottom 116 of the shaft 112 has the smallest diameter, the distance L1 between the lowermost helical plate 124 and the helical plate 122 directly above is less than the distance L2 between the helical plate 120 and its adjacent helical plate 122 is greater than L1.

With this configuration, the smallest helical plate 124 adjacent the tip 130 of the pile 100 is the first helical plate that disturbs, or breaks, the surface when the pile 100 is inserted into the ground. As the helical plate diameter increases, the amount of torque required to insert the pile 100 increases. Thus, when the top helical plate 120 with the largest diameter is driven into the ground, the greatest amount of torque that is required for rotating the helical plate 120 is compromised because of the force or impact on the smaller helical plates 120, 122, 124 already positioned below the ground surface.

In response to this recognition, certain devices have been designed to better withstand the rigors of digging large holes in the ground. Examples of prior art are disclosed in U.S. Pat. No. 2,603,319 to Dyche, U.S. Pat. No. 7,635,240 to Gantt, Jr., and U.S. Pat. No. 7,494,299 to Whitsett which are hereby incorporated by reference.

SUMMARY OF THE INVENTION

The present invention provides an easy to use helical screw pile that penetrates the ground and enables subsequent, smaller helical plates on a pile to penetrate the ground after the lowermost helical plate with the largest diameter has penetrated the ground. The helical screw pile of the invention provides a helical pile where a larger torque is concentrated towards the bottom end of the pile than the torque at the top end of the pile. The helical plates can be joined to form a substantially continuous helix or spaced apart along the shaft. In one embodiment, the helical pile is designed such that the distance between the lowermost helical plate and the adjacent helical plate is greater than that of the prior conventional piles although the spacing can vary depending on the soil and intended use of the helical pile. The spacing between the lowermost helical plate and the adjacent plate can be greater than the spacing between the uppermost helical plate and the adjacent plate.

The helical pile of the present invention has at least two helical plates on a shaft for penetrating the ground where the larger diameter of the helical plates is positioned closest to the bottom end of the shaft. The helical pile can have three or more helical plates where each helical plate has a diameter less than the diameter of the helical plate toward the lower, ground-engaging end. Each helical plate can be spaced apart axially or joined to each other to form a continuous helix.

The spacing between two adjacent helical plates of the invention is a function of the diameter of the lower helical plate. In one embodiment, the spacing can be three times the diameter of the lowermost helical pile although the spacing can vary. This generally results in the spacing between two adjacent helical plates being greater than the spacing of the prior devices where the smaller plate is positioned below the larger plate. The spacing between the adjacent helical plates can vary depending on the soil type, the required strength or holding force and the intended depth of penetration.

Accordingly, an object of the invention is to provide a helical screw pile having a longitudinal shaft with a top and a bottom and a plurality of helical screw plates with different diameters arranged thereon with the plate having the largest diameter located adjacent or near the bottom end of the pile. In one embodiment of the invention, each of the helical plates are spaced apart from each other a distance to provide a relatively constant torque at the bottom end of the shaft during rotation and penetration of the helical screw pile into the ground to the desired depth. The screw pile is provided with the largest diameter helical screw plate toward the bottom end of the shaft and the smallest diameter helical screw plate toward the top end of the shaft. The larger helical screw plate penetrates the ground first so that the largest amount of the torque is applied at the bottom end of the shaft. The small helical screw plates located above the lowermost plate penetrate the ground after the larger lowermost plate so that the torque necessary for the screw pile to penetrate the ground is generally less than when the smaller diameter helical plates penetrate the ground first. The arrangement of the helical screw plates enables the screw pile to penetrate the ground while applying a more constant torque to the shaft with each of the subsequent helical screw piles penetrating the ground to anchor into the ground.

Another object of the invention is to provide a helical screw pile having a longitudinal shaft with a top end and a bottom end and a plurality of helical plates arranged thereon with the plate having the smaller diameter located above a large diameter plate.

A further object of the invention is to provide a helical screw pile having a longitudinal shaft with a top and a bottom and a plurality of helical plates arranged thereon with the distance between the bottom plate and the plate second from the bottom being larger than the distance between the top plate and the plate second from the top.

Yet another object of the invention is to provide a helical screw pile having a plurality of helical plates arranged thereon wherein each of the helical plates has a thickness that is directly proportional with its diameter.

Still another object of the invention is to provide a helical screw pile having a plurality of helical plates arranged thereon wherein each of the helical plates has a diameter ranging from about six inches to about thirty inches, a plate thickness between about ⅜ to about 1.0 inch, a pitch angle between about 15° to about 30°, and a pitch opening between three and six inches.

The foregoing objects are basically attained by providing a helical screw pile for penetrating the ground and forming a support having a longitudinal shaft with a top end and a bottom end and a plurality of helical plates arranged on the longitudinal shaft in increasing diameter from the top to the bottom. A first helical plate is disposed toward the bottom end of the shaft and a second helical plate is disposed toward the top end of the shaft. The first helical plate has the largest diameter of the plurality of helical plates and the second helical plate has the smallest diameter of the plurality of helical plates. The helical plates can be spaced apart along the axis of the shaft. The helical plates can also be contiguous to form a continuous helix with a diameter that decreases as the helix extends away from the ground engaging tip.

The foregoing objects are also attained by providing a helical screw pile including an inter-helical spacing between adjacent helical plates equivalent to three times the plate diameter of the larger of the two adjacent helical plates. For example, in embodiments where there are at least three helical plates arranged in descending order of helical plate diameter from the tip at the bottom end of the pile adjacent or near the bottom end of the longitudinal shaft towards the top end of the pile, the distance between the bottom plate and the middle plate directly above is greater than the distance between the top plate having the smallest diameter and the middle plate directly below the top plate.

The foregoing objects are further attained by providing a ground anchor for penetrating the ground to anchor a structure. The ground anchor comprises a shaft having a longitudinal dimension with a first leading end for penetrating the ground and a second trailing end for coupling to a drive assembly. A first helical plate is coupled to the shaft proximate the first end. The first helical plate has a first diameter and requires a first torque for penetrating the ground. A second helical plate is coupled to the shaft and longitudinally spaced from the first helical plate toward the second trailing end. The second helical plate has a second diameter less than the first diameter and generally requires a second torque for penetrating the ground that is less than the first torque where the greatest torque is concentrated toward the first end of the shaft.

The features of the invention are further attained by providing a ground anchor having a shaft with a leading end for penetrating the ground, a second trailing end and a plurality of helical plates of incrementally decreasing diameters from the leading end toward the trailing end. Each of the plates are fixed to the shaft with the largest diameter being closest to the leading end of the shaft and the smallest diameter spaced furthest from the leading end. The trailing end of each helical plate contacts the leading end of the adjacent plate to form a substantially continuous helical plate assembly. The plates can be welded together or spaced apart a small distance.

As used in this application, the terms "top", "bottom", and "side" are intended to facilitate the description of the helical screw pile, and are not intended to limit the description of the invention.

Other objects, advantages, and salient features of the present invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

Throughout the drawings, like reference numerals will be understood to refer to like parts, components, and structures.

DETAILED DESCRIPTION OF THE INVENTION

Figure 1:
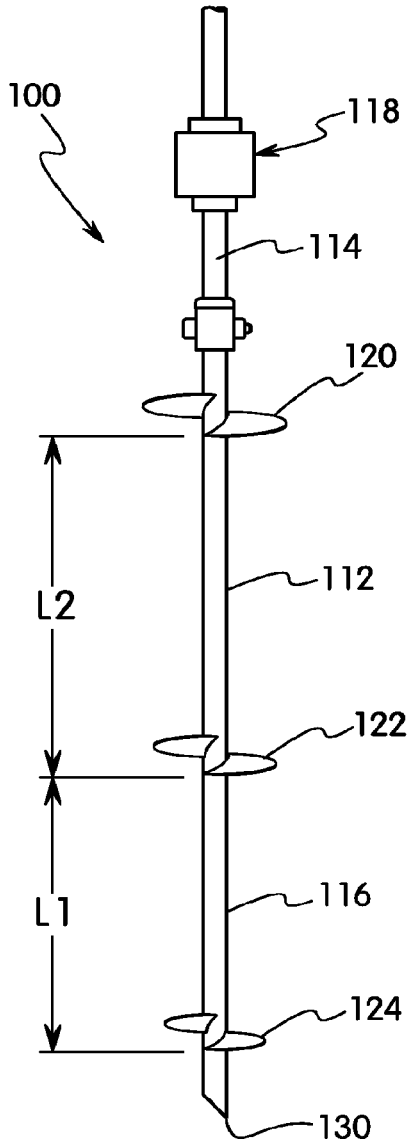
FIG. 1 (PRIOR ART)
FIG. 1 is a front perspective view of a convention helical screw pile as known in the prior art.

The present invention is directed to a helical screw pile defining an earth or ground anchor for anchoring, supporting and/or stabilizing a structure. The helical screw pile for example can be used as a ground anchor or foundation anchor to inhibit movement of pipelines, towers and the like, and to support a load such as a building or other structure. The helical screw pile is attached to a suitable coupling mechanism that is attached to the structure being anchored, supported or stabilized. For purposes of convenience, the structures being anchored or stabilized are not shown in the drawings. It will be understood to those skilled in the art that in use, the screw pile is coupled to a structure such as a building to support the building or to a pipeline anchor to prevent movement of the pipeline. It will be understood by those skilled in the art that the screw pile of the invention can be driven into the ground using standard equipment and techniques.

Turning to FIGS. 2-7, a helical screw pile 10 includes a longitudinal shaft 12 having a top end portion 14 and a bottom end portion 16 with a plurality of spaced-apart helical plates 20, 22, 24 arranged thereon. The bottom end portion 14 of the helical screw pile is adapted for penetrating the ground and terminates at a pointed tip 30. The top end portion 14 is adapted for mating with a rotating motor 18 by a suitable coupling 50. The coupling provides easy connection to the screw pile 10 for penetration and installation in the ground.

Figure 2:
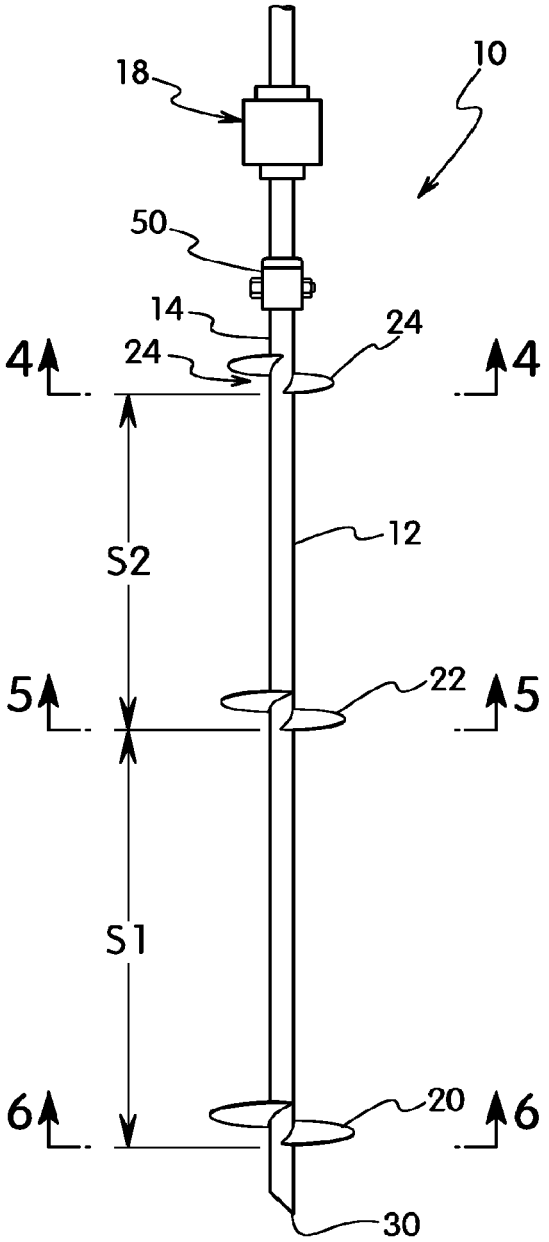
FIG. 2 is a front perspective view of a helical screw pile according to one embodiment of the present invention having three helical plates.
Figure 2A:
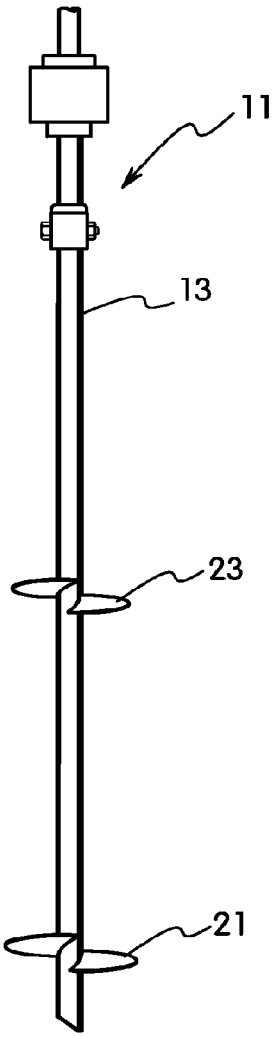
FIG. 2A is a front view of a screw pile having two helical plates.

In the embodiment of FIG. 2A, a helical screw pile 11 has a shaft 13 with two spaced-apart helical plates 21 and 23. In each of the embodiments of the invention, the helical plates are positioned on the shaft with the largest diameter of the helical plates positioned toward the bottom end of the shaft and each successively smaller diameter helical plate positioned above the lower helical plate toward the top end of the shaft. For purposes of discussion, the embodiment of FIGS. 2-7 has three helical plates although it will be understood that more or fewer helical plates can be provided as needed.

Referring to the embodiment of FIGS. 2-7, shaft 12 can have a round or square cross-section. In the embodiment illustrated, the shaft 12 has a round cross-section with a square end for mating with coupling 50 to effectively transfer torque from the drive motor 18 to the shaft 12. The helical plates according to the invention are arranged in descending size from the tip 30 of the pile 10 adjacent or near the bottom portion 16 of the shaft 12 towards the top portion 14 of the pile 10 near the hydraulic motor 18 for rotating the shaft. In a preferred embodiment illustrated in FIG. 2, the first helical plate 20 with the largest diameter D1 is closest to the tip 30 at the bottom end portion of the shaft 12. The helical plates 22, 24 are arranged on the shaft 12 in descending order of decreasing diameter towards the top end portion 14 and hydraulic motor 18 or other generic rotating device. The diameter of each respective helical plate 20, 22, 24 decreases toward the top end portion such that the helical plate 24 having the smallest diameter D3 is positioned toward the top end portion 14 of the shaft 12, the largest diameter D1 is positioned toward the bottom end portion 16 and the intermediate diameter D2 is between the smallest plate 24 and largest diameter plate 20.

The largest diameter helical plate 20 shown in FIG. 2 and the larger diameter helical plate 21 shown in FIG. 2A are positioned toward the bottom end portion of the shaft. The smaller diameter helical plate at the top end has been found to exhibit increased anchoring or holding ability compared to the prior anchors at similar depths that position the smaller plate toward the bottom end and the larger plate toward the top end. The largest diameter helical plate of the invention is able to penetrate the ground to a greater depth thereby increasing the holding power. The smaller helical plates are able to penetrate the ground after the larger helical plate so that the torque necessary to screw the pile into the ground generally does not increase compared to the prior screw pile as each successively smaller helical plate penetrates the ground while each successive plate provides increased holding and anchoring ability.

Figure 3:
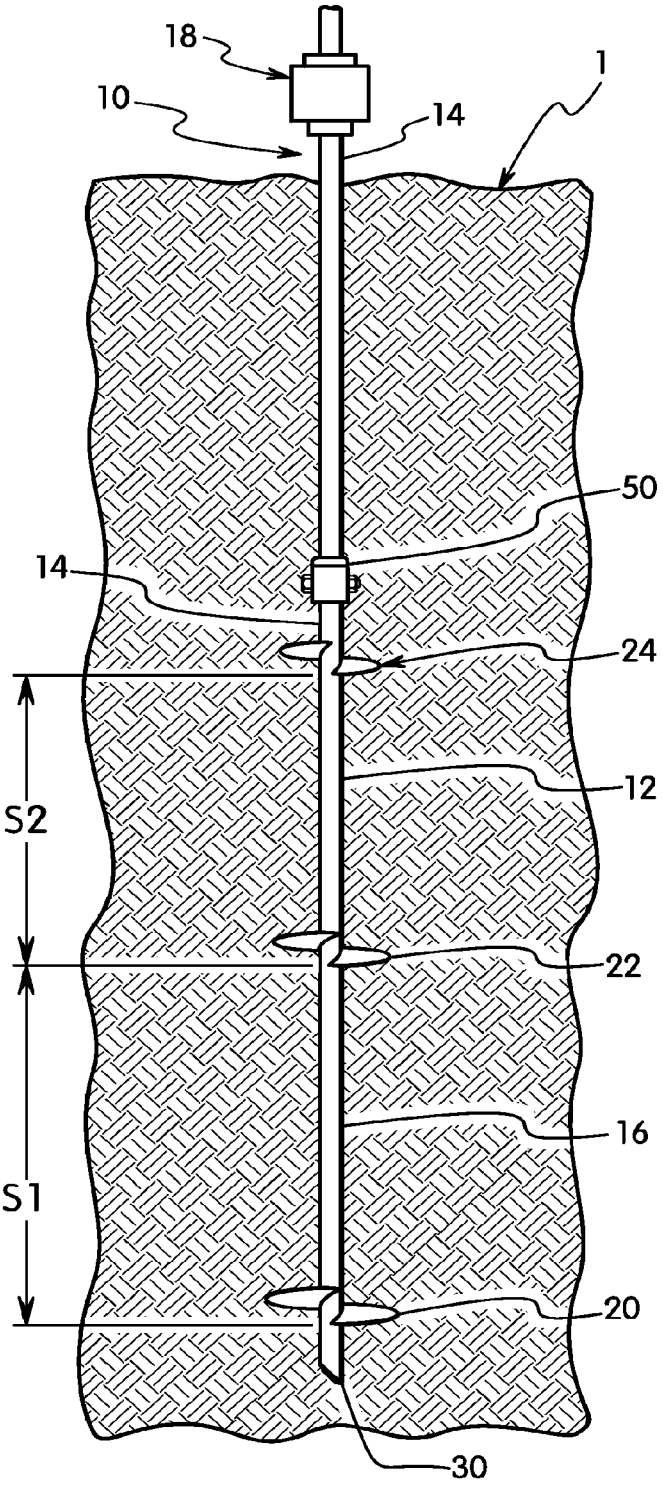
FIG. 3 is a front perspective view of the helical screw pile seen in FIG. 2 submerged in dirt beneath the earth's surface.

In the embodiment illustrated in FIGS. 2 and 3, the helical pile includes three helical plates 20, 22, 24. The third helical plate 24 disposed toward the top end portion 14 of the longitudinal shaft 12 has the smallest diameter D3. The second or middle helical plate 22 has the second smallest diameter D2, and the first or bottom helical plate 20, located toward the bottom end portion 16 of the longitudinal shaft 12, has the largest diameter D1.

Figure 4:
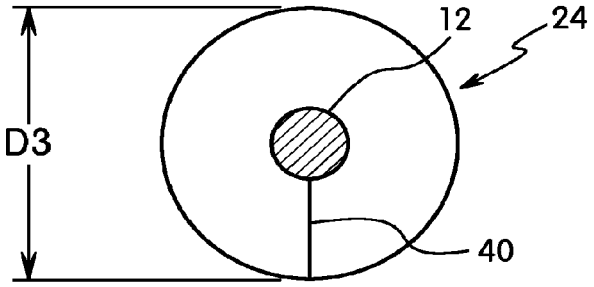
FIG. 4 is a bottom sectional view of the helical plate illustrated in FIG. 2 along the line 4-4.
Figure 5:
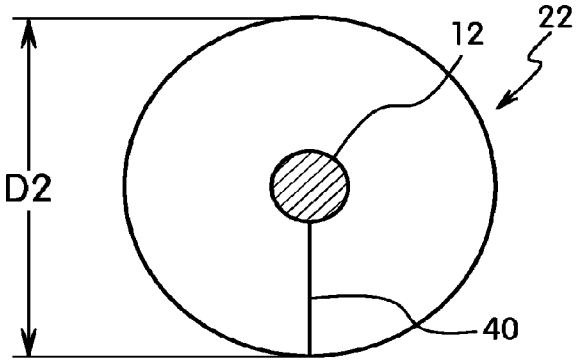
FIG. 5 is a bottom sectional view of the helical plate illustrated in FIG. 2 along the line 5-5.
Figure 6:
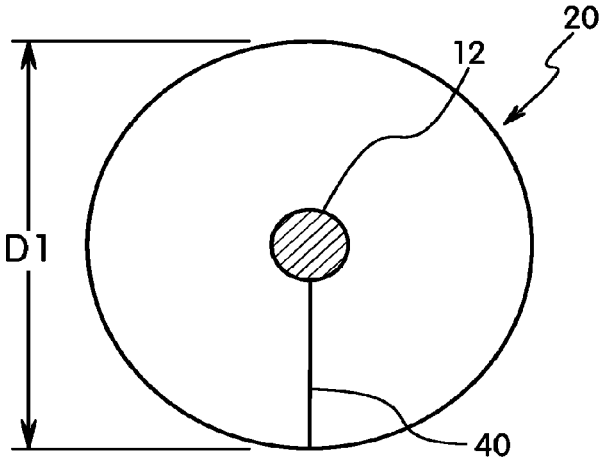
FIG. 6 is a bottom sectional view of the helical plate illustrated in FIG. 2 along the line 6-6.

As seen in FIGS. 4-6, the helical plates 20, 22, 24 all have similar structure and design and differ primarily by the diameter of the plates. They are integrally connected to the shaft 12 in the embodiment of FIGS. 2-6. In one embodiment, the helical plates 20, 22 and 24 are integrally formed with the shaft 12 as a one piece unit. The helical plates can be formed with the shaft or formed separately and welded directly to the shaft in a manner similar to the pile shown in FIG. 1. In an alternative embodiment, each helical plate can be formed with a body having an axial bore for receiving the shaft 12. The body of each helical plate is fixed to the shaft 12 by welding or by a suitable fastener.

Each helical plate 20, 22, 24 typically forms a substantially 360° helical turn. Alternatively, each helical plate can extend around the shaft less than 360° or more than 360° depending on the intended use and soil conditions. Generally, the helical plates 20, 22, 24 have a pitch angle substantially between 15° and about 30° and a pitch opening substantially between about three inches and about six inches. The pitch opening 28 is determined by the pitch angle of the helical plate in a 360° turn and corresponds to the distance between the threads of the helical plate for each 360° rotation of helical plate 20, 22, 24. In other words, the pitch opening 28 is equivalent to approximately the distance from the top of the bottom portion of the plate at the leading edge 40 to the bottom of the top portion of the opposing side of the plate at the trailing edge 42. At least one of the helical plates 20, 22, 24 has a plate thickness between about ⅜ inch and about 1.0 inch. Typically, each of the plates has the same pitch angle and pitch opening.

The primary difference between each of the helical plates 20, 22, 24 is the diameter size D1, D2, D3. Each of the helical plates 20, 22, 24 has a diameter D1, D2, D3, respectively. In one embodiment, the diameters range from about six inches to about 30 inches. Each helical plate 20, 22, 24 has a thickness that is directly proportional to the diameter D1, D2, D3 to provide the necessary strength. As the diameter D1, D2, D3 of the helical plate 20, 22, 24, respectively, increases, the thickness of the helical plate 20, 22, 24 also increases. Thus, helical plate 20, illustrated in FIG. 6, having diameter D1 is the thickest plate, and helical plate 24, illustrated in FIG. 4, having diameter D3 is the thinnest plate. The diameter of the plates can vary but generally range from about 6 to 30 inches. In one embodiment, the largest helical plate has a diameter of about 24 inches. In another embodiment, the largest can have a diameter of about 30 inches.

The spacing between the helical plates is generally a function of the plate diameter of the lower plate, soil conditions and desired anchoring strength. In one embodiment as shown in FIG. 2, the inter-helix spacing or first distance S1 between the first helical plate 20 and a second, smaller helical plate 22 is greater than the second distance S2 between the second helical plate 22 and the third helical plate 24. In the embodiment shown, the first distance S1 between helical plates 20 and 22 is approximately three times the first diameter D1 of helical plate 20. The second distance S2 between helical plate 22 and helical plate 24 is approximately three times the second diameter D2 of helical plate 22. Thus, the inter-helix spacing of the present invention is larger at the bottom end portion 14 of the pile 10 between the first helical plate 20 and the second helical plate 22 positioned directly above helical plate 20 than the spacing between the second helical plate 22 and the third helical plate 24. As a result, the distance between the lowermost helical plate and the uppermost helical plate is greater in relation to the spacing between the upper helical plates than conventional screw piles.

In other embodiments, the spacing between the helical plates can be selected depending on the soil conditions, the desired depth of penetration, as well as other conditions. For example, the spacing between adjacent helical plates can be about 0.5, 1.0 or 1.5 times the diameter of the lower helical plate. In other embodiments of the invention, the spacing can be about 6 inches corresponding to about 0.5 times the diameter of the lower plate. A smaller spacing may be desirable when used in lighter soils. A typical soil condition generally benefits from the spacing between two adjacent helical plates of about three times the diameter of the lower helical plate.

The diameter of each of the helical plates can be selected as needed. In one exemplary embodiment, a three-plate pile can have plates with diameters of 12/10/8 inches and 12/8/6 inches. In other two-plate piles, the plates can have diameters of 12/10 inches, 12/8 inches and 12/6 inches. Preferably, each helical plate has a uniform radius and diameter throughout the helical turn. The leading edge of each helical plate has a radial length that is substantially equal to the radial length of the trailing end.

The spacing between two adjacent helical plates can be a function of the diameter of the lower helical plate so that the spacing between the adjacent helical plates will vary depending on the diameter of the lower helical plate. The spacing can range from about 0.5 to 3 times the diameter of the lower plate. In the present invention, the larger helical plate is positioned below the smaller adjacent helical plate. The spacing between the adjacent helical plates of the present invention can be greater than the spacing between the helical plates of the prior screw piles for similar size helical plates. In the embodiment illustrated where three helical plates are provided, the spacing between the bottom helical plate and the middle helical plate is generally greater than the spacing between the corresponding helical plates of the prior devices. This embodiment results in the overall length of the screw pile of the invention being greater than the length of the prior devices for similar diameter helical plates. In one embodiment of the invention, the length of the screw pile can be similar to the length of the prior devices by reducing the diameter of the helical plates without loss of holding power during use.

Figure 7:
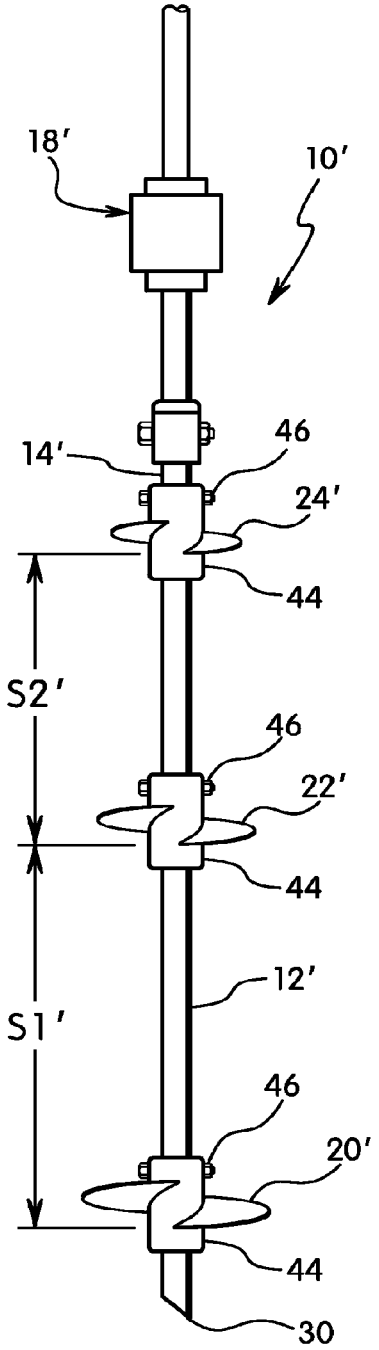
FIG. 7 is a front sectional view of a helical plate according to a second embodiment of the present invention.

In another embodiment, illustrated in FIG. 7, the first distance S1' is less than three times the largest diameter D1 of helical plate 20'. In the embodiment of FIG. 7, the components of the helical screw pile 10' are substantially the same as in the embodiment of FIGS. 1-6 and are identified by the same reference number with the addition of a prime. The second distance S2' shown in FIG. 7 is less than three times the smaller diameter D2' of helical plate 22'. With this relationship, the first distance S1' is greater than the second distance S2. In a further embodiment, the distance between the first and second helical plates is more than three times the diameter of the first plate. The distance between the second plate and the third plate is more than three times the diameter of the second plate.

Each of the helical plates 20, 22, 24 can be integrally formed with the shaft 12 as a one piece unit. In the embodiment illustrated in FIG. 7, each helical plate has a cylindrical central body 44 with an axial bore having a dimension to receive the shaft 12'. In the embodiment shown, the shaft 12' has a square cross-section received within the axial bores. The helical plates are fixed to the shaft by a suitable fastener such as a bolt 46 that extends through a transverse hole in the body 44 and the shaft 12'. Alternatively, the helical plates can be coupled to the shaft by welding.

One advantage of arranging the helical pile 10 as described in the preferred embodiment with the helical plate 20 having the largest diameter D1 on the bottom 16 of the shaft 12, closest to the tip 30 of the pile 10 penetrates the ground first and enables the smaller helical plates 22 and 24 of the pile 10 to drill into the ground surface 1 shown in FIG. 3 with less change in resistance than when the smaller helical plates penetrate the ground first while increasing the holding force of the screw pile. As the helical plate diameter increases, the amount of torque required to rotate the helical screw pile 10 within the ground increases. Thus, the greatest amount of torque is applied by the bottom helical plate 20 penetrating the ground surface and the greatest amount of torque is directed toward the bottom end portion 16 of the shaft 12.

The arrangement of the helical plates on the shaft according to the present invention provides a more constant torque at the bottom end portion 16 of the shaft compared to a helical pile having the larger plate at the top end. Providing the larger of the helical plates toward the bottom end of the shaft and the smaller plate toward the top end of the shaft does not cause significant increases in torque on the upper portion of the shaft 12 as each successively smaller plate penetrates the ground. The smaller plates are able to penetrate the ground more readily by the lowermost larger plates having penetrated the ground while still providing anchoring and supporting ability. The smaller helical plates experience less penetration resistance in the ground so there is a smaller increase in torque applied to the shaft as each helical plate penetrates the ground.

Field tests have demonstrated that the preferred embodiment arrangement of the plates shown in FIG. 2 is more effective than conventional helical piles 100 (illustrated in FIG. 1) having the smallest helical plate 124 positioned near the bottom 116 of the longitudinal shaft 112. The advantage in arranging the helical plates 20, 22, 24 as disclosed in the foregoing with the smaller plate toward the top end of the shaft is that the amount of load concentrated towards the top 14 of the shaft 12 is less than that of conventional arrangements 100 and the bulk of the torque is concentrated closer to the lowermost helical plate 20 having the largest diameter D1 toward the bottom end of the shaft. A greater load is applied toward the bottom of the shaft having the largest diameter helical plate.

Field tests also demonstrate that arranging the helical pile 10 with the helical plate 20 having the largest diameter D1 toward the bottom 16 of the shaft 12 provides greater anchoring capacity and strength over a conventional helical pile 10 having the larger plate at the top end. The preferred embodiment was tested in sand and clay soils exhibit and increase in tension capacity from about 25% to about 40% when compared to the conventional configuration at similar depths. This is a significant capacity increase when the soils are homogenous and relatively consistent.

Figure 8:
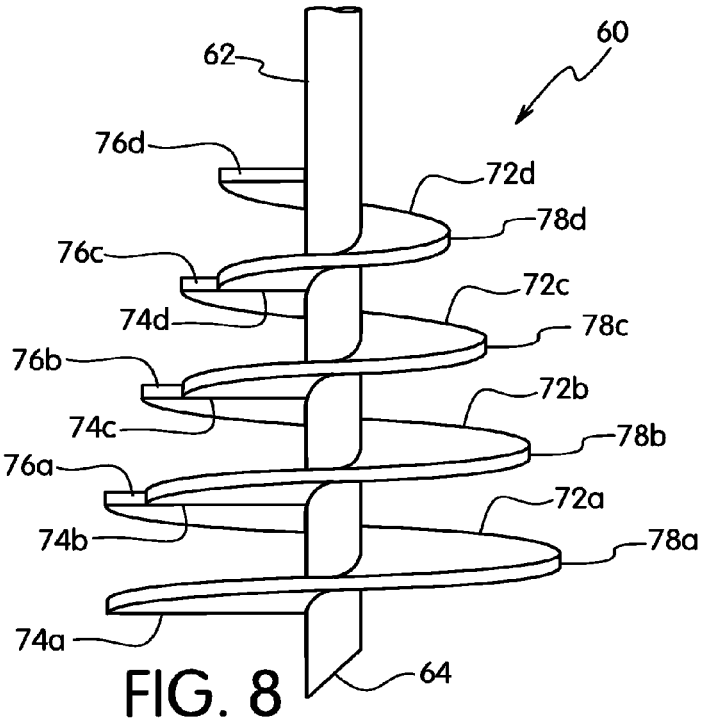
FIG. 8 is a side view of the ground anchor in another embodiment of the invention showing the plurality of helical plates coupled together.
Figure 9:
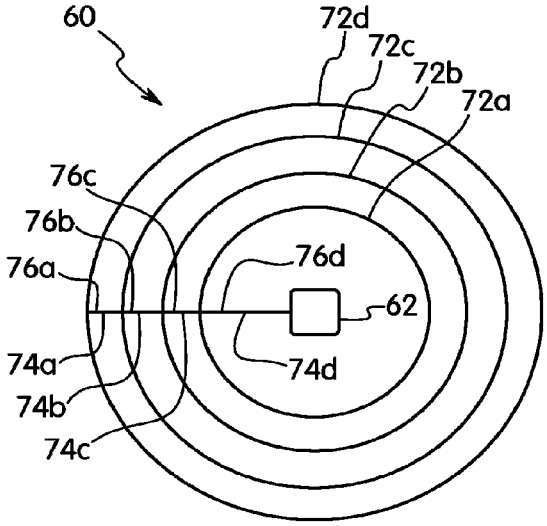
FIG. 9 is a top view of the ground anchor of FIG. 8.

FIGS. 8 and 9 show another embodiment of the invention for a ground anchor for drilling into the ground for supporting a load. The ground anchor 60 includes a shaft 62 with a pointed tip 64 for penetrating the ground 66. The top end of the shaft 62 has a coupling 68 as in the previous embodiments for connecting to a load such as building structure 70 and as shown in FIG. 10.

Figure 10:
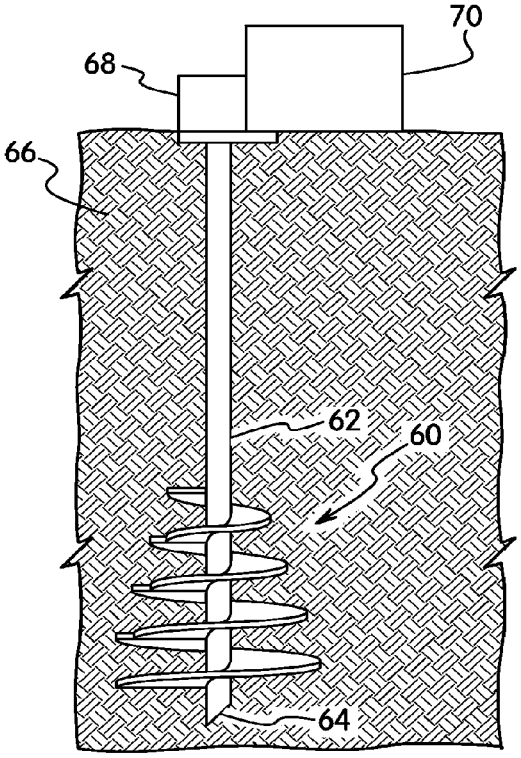
FIG. 10 is a side view of the ground anchor of FIG. 8 embedded in the ground.

The ground anchor 60 in the embodiment of FIGS. 8-10 includes a plurality of helical plates 72*a*, 72*b*, 72*c* and 72*d* connected together to form a substantially continuous helix with a diameter that decreases from the tip 64 of the shaft 62 towards the upper end of the shaft. Each helical plate has a leading edge 74*a*, 74*b*, 74*c* and 74*d*, and trailing edge 76*a*, 76*b*, 76*c* and 76*d*, respectively, where the trailing edge of each helical plate contacts the leading edge of the adjacent helical plate. In one embodiment, each helical plate is welded to the shaft 60 and the contacting plates can be spaced apart a distance greater or less than the embodiment shown. In one embodiment, the helical plates can be spaced apart a distance corresponding to the height of the adjacent helical plate. In other embodiments, the distance between the helical plates can be about 0.5 to 3 times the diameter of the lower helical plate as in the previous embodiments.

In the embodiment of FIGS. 8-10, each helical plate 72*a*, 72*b*, 72*c* and 72*d* has a decreasing diameter from the ground penetrating end to the top end coupled to the structure being anchored or supported. Referring to FIG. 8, helical plate 72*a* at the bottom end of the shaft 60 adjacent or nearest the point 64 forms a helix extending about 360° corresponding to one revolution of the helical plate around the shaft so that the leading edge 74*a* is axially aligned with the trailing edge 76*a* with respect to the longitudinal axis of the anchor shaft 62. The outer edge 78*a*, 78*b*, 78*c* and 78*d* of the helical plates 72*a*, 72*b*, 72*c* and 72*d*, respectively, is uniformly spaced from the center axis of the shaft 62 to form a circle when viewed in the axial direction as shown in FIG. 9. Each helical plate has a substantially uniform radius and diameter around the helical turn. As in the previous embodiment, the helical plates can have a pitch angle of about 15° to about 30°, a pitch opening of about 3 to about 6 inches, and a diameter of about 6 to about 30 inches.

The adjacent helical plate 72*b* has a similar shape as the helical plate 72*a* and has a slightly smaller diameter. Helical plate 72*b* has a leading edge 74*a* abutting the trailing edge 76*a* of helical plate 72*a*. As shown in FIG. 8, the helical plate 72*b* has a smaller diameter than the helical plate so that a portion of the trailing edge 76*a* of the helical plate 72*a* is exposed to contact the ground when being driven into the ground. The third helical plate 72*c* has a similar shape as the helical plate 72*b* with a smaller diameter so that a portion of the trailing edge 76*b* of the second helical plate 72*b* is exposed. The third helical plate 72*c* has a leading edge 74*c* abutting the trailing edge 76*b* of the second helical plate 72*b*. The third helical plate 72*c* also has a leading edge 74*c* abutting the trailing edge 76*b* of the second helical plate 72*b*. The fourth helical plate 72*d* also has a similar shape with a diameter less than the diameter of the third helical plate 72*c* so that a portion of the trailing edge 76*c* of the third helical plate 72*c* is exposed. The fourth helical plate 72*d* has a free trailing edge 76*d* as shown in FIG. 8.

The diameter of each helical plate is smaller than the adjacent helical plate nearest the tip 64. The diameter of each adjacent plate can decrease by a uniform amount as shown in FIG. 8 and FIG. 9 to form a continuous and uniform decrease in diameter. In this embodiment, the diameter of each helical plate is reduced about 20% from the lower helical plate. The diameter of each helical plate can be about 15% to about 30% less than the lower adjacent helical plate.

As shown in FIG. 8, each helical plate has substantially the same pitch angle and pitch opening so that each helical plate has substantially the same axial length. In alternative embodiments, each helical plate can have a different pitch angle and pitch opening so that each helical plate has a shorter or longer axial length than the adjacent helical plate. In one embodiment, the pitch opening and pitch angle decrease about 10% to about 20% from the lower adjacent helical plate. Alternatively, the pitch opening and pitch angle can increase about 10% to about 20% from the adjacent helical plate. In other embodiments, each helical plate can have a continuous spiral shape where the diameter decreases from the leading edge to the trailing edge so that the trailing edge has a length less than the length of the leading edge.

Each of the helical plates 72*a*, 72*b*, 72*c* and 72*d* can be mounted on the shaft 62 so that the trailing edges contact or abut the leading edge of the juxtaposed helical plate. In other embodiments, the respective trailing and leading edges can be welded together or fixed together by suitable means. In the embodiment shown, the trailing and leading edges of the juxtaposed helical plates are aligned to form a substantially continuous surface. In the embodiment shown, each helical plate extends around the shaft about 360°. In other embodiments, each helical plate can extend around the shaft more than 360° or less than 360°.

Figure 11:
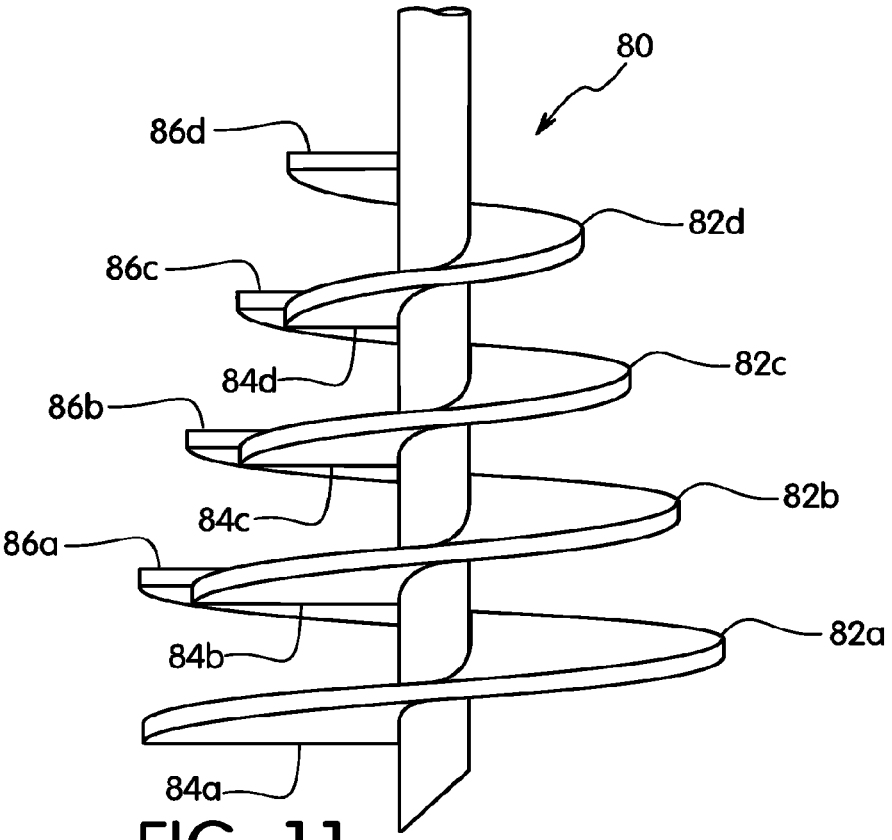
FIG. 11 is a side view of a further embodiment of the invention showing the leading and trailing ends of the helical plates staggered with respect to each other.
Figure 12:
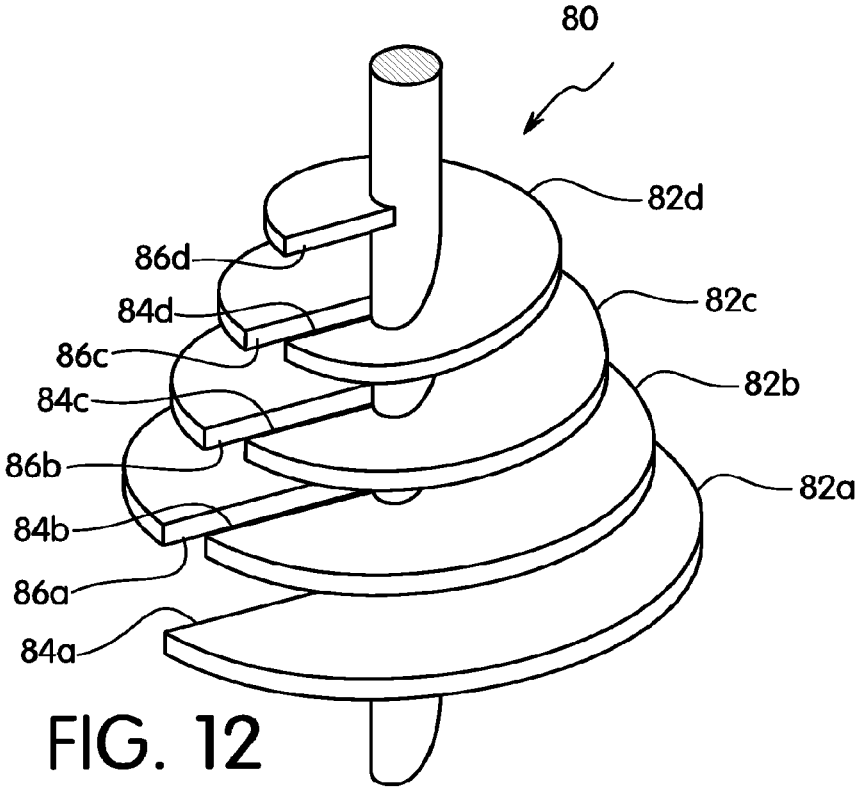
FIG. 12 is a top perspective view of the ground anchor of FIG. 11.

In another embodiment shown in FIGS. 11 and 12, the ground anchor 80 has a plurality of helical plates 82*a*, 82*b*, 82*c* and 82*d* in a manner similar to the previous embodiment of FIGS. 8-10. Each helical plate 82*a*, 82*b*, 82*c* and 82*d* has a leading edge 84*a*, 84*b*, 84*c* and 84*d* and a trailing edge 86*a*, 86*b*, 86*c* and 86*d*, respectively. In this embodiment, the helical plates each have a different pitch as shown in FIGS. 11 and 12 so that the leading edge of each helical plate partially overlaps the trailing edge of the adjacent helical plate. As shown in FIGS. 11 and 12, the outermost radial end of the leading edges of the helical plates extends below the trailing edge of the adjacent helical plate with respect to the end of the shaft. The innermost end of the respective leading edge is aligned with and abuts the innermost edge of the trailing edge of the adjacent helical plate as shown in FIG. 12. In this embodiment, each helical plate in the series has a smaller diameter and a greater pitch than the adjacent helical plate. In alternative embodiments, the helical plates can be spaced apart on the shaft so that the leading edge of the smaller helical plate 82*b* is below the trailing edge 86*a* with respect to the ground engaging tip. The leading edge of each successive helical plate can also be spaced below the trailing edge of the lower adjacent helical plate.

Figure 13:
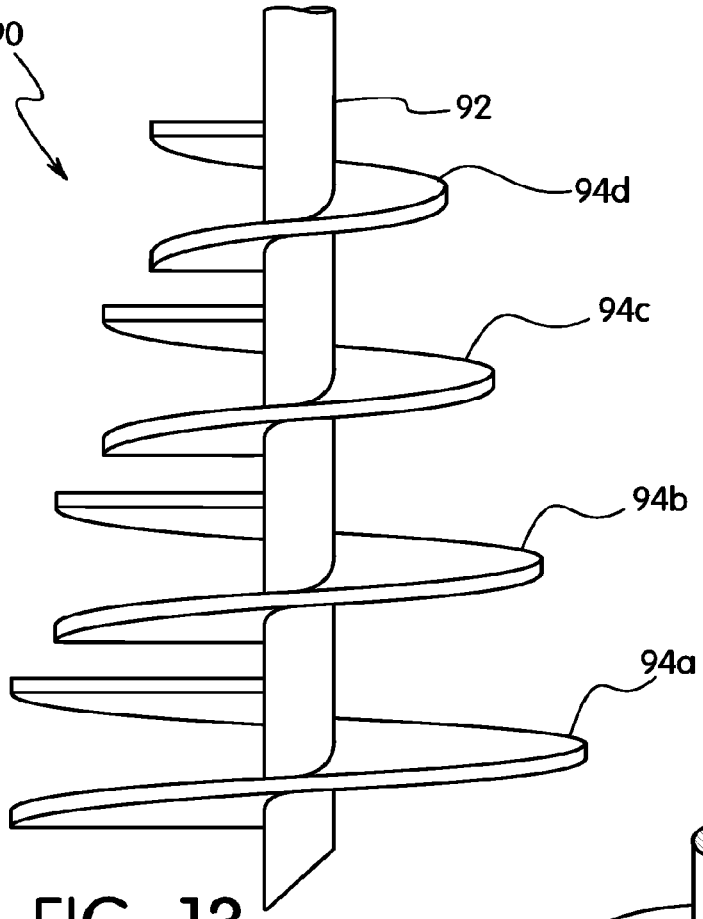
FIG. 13 is a side view of the ground anchor in another embodiment of the invention.
Figure 14:
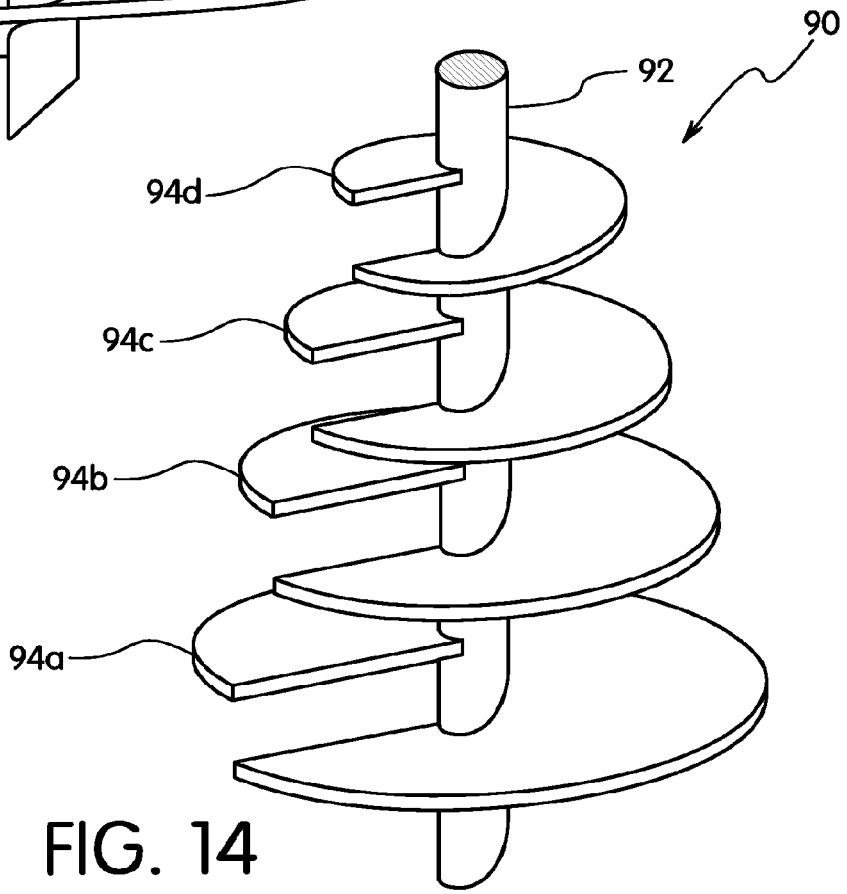
FIG. 14 is a top perspective view of the ground anchor of FIG. 13.

In the embodiment of FIGS. 13 and 14, the ground anchor 90 includes shaft 92 and helical plates 94*a*, 94*b*, 94*c* and 94*d* where each helical plate has a smaller diameter than the adjacent helical plate positioned toward the ground engaging tip. Each helical plate has substantially the same axial length. In this embodiment, each helical plate is axially spaced from the adjacent helical plate. In the embodiment shown, each of the helical plates are positioned so that the leading and trailing edges of the each adjacent helical plate are axially aligned with respect to the longitudinal axis of the ground anchor so that the trailing edge of the lower helical plate is aligned with the leading edge of the adjacent helical plate. Each of helical plates 94*a*, 94*b*, 94*c* and 94*d* have substantially the same axial length and pitch opening. The helical plates are spaced apart a distance of about 25% of the axial length of the helical plate.

The spacing between the helical plates can vary depending on the soil conditions and the dimensions of the helical plates. In the embodiment shown, the helical plates are spaced apart a distance about half the pitch or height of the adjacent helical plate. In the embodiment shown, the leading and trailing edges of the helical plates are axially aligned. In other embodiments, the leading edge and the trailing edge of the adjacent helical plates can be spaced around the perimeter of the ground anchor so that the leading edge of one helical plate is not axially aligned with the trailing edge of the adjacent helical plate.

While a particular embodiment has been chosen to illustrate the invention, it will be understood by those skilled in the art that various changes and modifications can be made therein without departing from the scope of the invention as defined in the appended claims.

What is claimed is:

1. A helical screw pile comprising:

a shaft having a top end and a bottom end for engaging the ground; and a plurality of helical plates arranged on the shaft in an order of decreasing diameter where the helical plate with the largest diameter is toward the bottom end and the helical plate with the smallest diameter is toward the top end, and wherein each of the plurality of helical plates are vertically spaced apart on the shaft a distance that is a function of the diameter of the helical plate toward the bottom end.

2. The helical screw pile according to claim 1, wherein a first helical plate of the plurality of helical plates has the largest diameter and is positioned closest to the bottom end of the shaft.

3. The helical screw pile according to claim 2, wherein a second helical plate of the plurality of helical plates is positioned on the shaft a distance of at least three times the first diameter away from the first helical plate.

4. The helical screw pile according to claim 3, wherein a third helical plate of the plurality of helical plates is positioned on the shaft a distance of at least three times the second diameter away from the second helical plate.

5. The helical screw pile according to claim 1, wherein each of the plurality of helical plates has a pitch angle between about 15° to about 30°.

6. The helical screw pile according to claim 1, wherein each of the plurality of plates has a pitch opening between about three inches and about six inches.

7. The helical screw pile according to claim 1, wherein at least one of the plurality of helical plates has a plate thickness between about ⅜ inch and about 1.0 inch.

8. The helical screw pile according to claim 1, wherein each of the helical plates forms a substantially 360° helical turn with a substantially uniform diameter throughout the helical turn.

9. The helical screw pile according to claim 1, wherein each of the helical plates has a diameter ranging from about six inches to about thirty inches.

10. The helical screw pile according to claim 1, wherein the plurality of helical plates comprises three helical plates positioned on the shaft in decreasing diameter from the bottom end to the top end, and wherein the first helical plate has a first diameter, the second helical plate has a second diameter that is smaller than the first diameter and the third helical plate has a third diameter that is smaller than the second diameter.

11. The helical screw pile according to claim 10, wherein the second helical plate is arranged on the shaft a distance of at least three times the first diameter away from the first helical plate.

12. The helical screw pile according to claim 11, wherein the third helical plate is arranged on the shaft a distance of at least three times the second diameter away from the second helical plate.

13. The helical screw pile according to claim 1, wherein the top end of the shaft includes a coupling that is adapted to mate with a motor.

14. A helical screw pile comprising:

a shaft having a top end and a bottom end for engaging the ground; and at least two helical plates arranged on the shaft in decreasing diameter from the bottom end to the top end, wherein a first of the at least two helical plates has a first diameter and is disposed toward the bottom of the shaft, and wherein a second of the at least two helical plates has a second diameter that is smaller than the first diameter.

15. The helical screw pile according to claim 14, wherein the first helical plate has the largest diameter and is positioned closest to the bottom end of the shaft.

16. The helical screw pile according to claim 15, wherein the second helical plate is arranged on the shaft a distance of at least three times the first diameter away from the first helical plate.

17. The helical screw pile according to claim 15, wherein the first and second helical plates have a pitch angle between about 15° to about 30°.

18. The helical screw pile according to claim 15, wherein at least one of the first and second helical plates has a pitch opening between about three and about six inches.

19. The helical screw pile according to claim 15, wherein at least one of the first and second helical plates has a plate thickness between about ⅜ inch and about 1.0 inch.

20. The helical screw pile according to claim 15, wherein each of the helical plates forms a substantially 360° helical turn with a substantially uniform diameter throughout the helical turn.

21. The helical screw pile according to claim 15, wherein each of the helical plates and has a diameter ranging from about six inches to about thirty inches.

22. The helical screw pile according to claim 15, wherein the top end of the shaft includes a coupling that is adapted to mate with a motor.

23. A helical screw pile comprising:

a shaft having a top end and a ground engaging bottom end;

a first helical plate having a first diameter and which is secured to the shaft at a point along the shaft toward the ground engaging bottom end of the plate;

a second helical plate having a second diameter that is smaller than the first diameter and which is secured to the shaft a distance from the first helical plate that is about three times the first diameter; and a third helical plate having a third diameter that is smaller than the second diameter and which is secured to the shaft a distance from the first helical plate that is about three times the first diameter.

24. The helical screw pile according to claim 23, wherein each of the helical plates form a substantially 360° turn and have a substantially uniform diameter throughout the helical turn.

25. The helical screw pile according to claim 23, wherein the diameter of each helical plate ranges from about six inches to about thirty inches.

26. The helical screw pile according to claim 23, wherein each of the helical plates has a pitch angle substantially between about 15° to about 30°.

27. The helical screw pile according to claim 23, wherein each of the helical plates has a pitch opening substantially between about three inches and about six inches.

* * * * *